United States Patent [19]

Simms et al.

[11] 4,133,918

[45] Jan. 9, 1979

[54] METHOD OF MARKING SEMICONDUCTORS

[75] Inventors: Douglas P. Simms, Sunnyvale; Anthony F. White, Cupertino; Carl W. Miller, Santa Clara, all of Calif.

[73] Assignee: The Computervision Corporation, Bedford, Mass.

[21] Appl. No.: 797,738

[22] Filed: May 16, 1977

[51] Int. Cl.[2] ..... B65D 47/18; B05D 5/00

[52] U.S. Cl. ..... 427/256; 427/82; 427/287; 427/288; 427/421; 222/420

[58] Field of Search ..... 427/82, 256, 287, 288; 222/420

[56] References Cited

U.S. PATENT DOCUMENTS

| | | | |
|---|---|---|---|
| 2,643,801 | 6/1953 | Kollmeyer | 222/420 |
| 3,476,291 | 11/1969 | Glaser | 222/420 |
| 3,572,558 | 3/1971 | Hooker | 222/420 |
| 3,677,447 | 7/1972 | Rentz | 222/420 |
| 3,810,779 | 5/1974 | Pickett | 222/420 |

*Primary Examiner*—Michael F. Esposito
*Attorney, Agent, or Firm*—Richard J. Birch

[57] ABSTRACT

A non-contacting, non-clogging, electro-mechanically operated marking device or inker for continuous or intermittently marking a semiconductor wafer die is disclosed together with a method of operating the device. The marking device has an ambient pressure ink reservoir within which is mounted a thin, capillary filament guide tube. A length of filament such as, fishline, is positioned within the tube and secured at one end to the plunger of a solenoid. The distal end of the filament is driven out of the capillary tube by the solenoid to force a small amount of the marking fluid or ink out of the reservoir and onto the die without the filament contacting the die. The solenoid coil is energized by a current pulse having a first current level and a second current level that is less than the first current level. The second current level provides a short holding current for the solenoid to prevent spattering of the marking fluid.

4 Claims, 4 Drawing Figures

METHOD OF MARKING SEMICONDUCTORS

BACKGROUND OF THE INVENTION

The present invention relates to marking devices in general and, more particularly, to a marking device for semiconductor wafer dies.

Various types of marking devices or "inkers" are used in the semiconductor industry to provide intermittent or continuous marks on semiconductor dies. Conventional inkers utilize a filament or fishline to transfer the marking fluid or ink to the semiconductor die by physically contacting the die. The action of the filament deposits the ink on the die at the time of contact between the filament and the die. The conventional inkers normally require maintenance at least every couple of hours and are susceptible to clogging with dried ink. Furthermore, in order to change the ink dot size with the conventional inkers, the filament itself must be changed. The disadvantages severely impair the usefulness of conventional "inkers" in high speed semiconductor production operations.

It is accordingly a general object of the present invention to provide an improved marking device or "inker" for semiconductor wafers.

It is a specific object of the present invention to provide a non-contacting, non-clogging inker for marking semiconductor wafer dies that eliminate the shortcomings of the prior art inkers.

It is still another object of the present invention to provide a semiconductor wafer die inker having a sufficient reservoir capacity to permit extended periods of operation between routine maintenance procedures.

It is a feature of the present invention that while the ink reservoir is maintained at ambient pressure, evaporation of the ink is minimized.

It is still another feature of the present invention that ink splatter is minimized through the use of a specific energerzation cycle for the inker solenoid.

These objects and other objects and features of the present invention will best be understood from a detailed description of a preferred embodiment thereof, selected for purposes of illustration and shown in the accompanying drawings, in which.

DETAILED DESCRIPTION OF A PREFERRED EMBODIMENT

Figure 1:
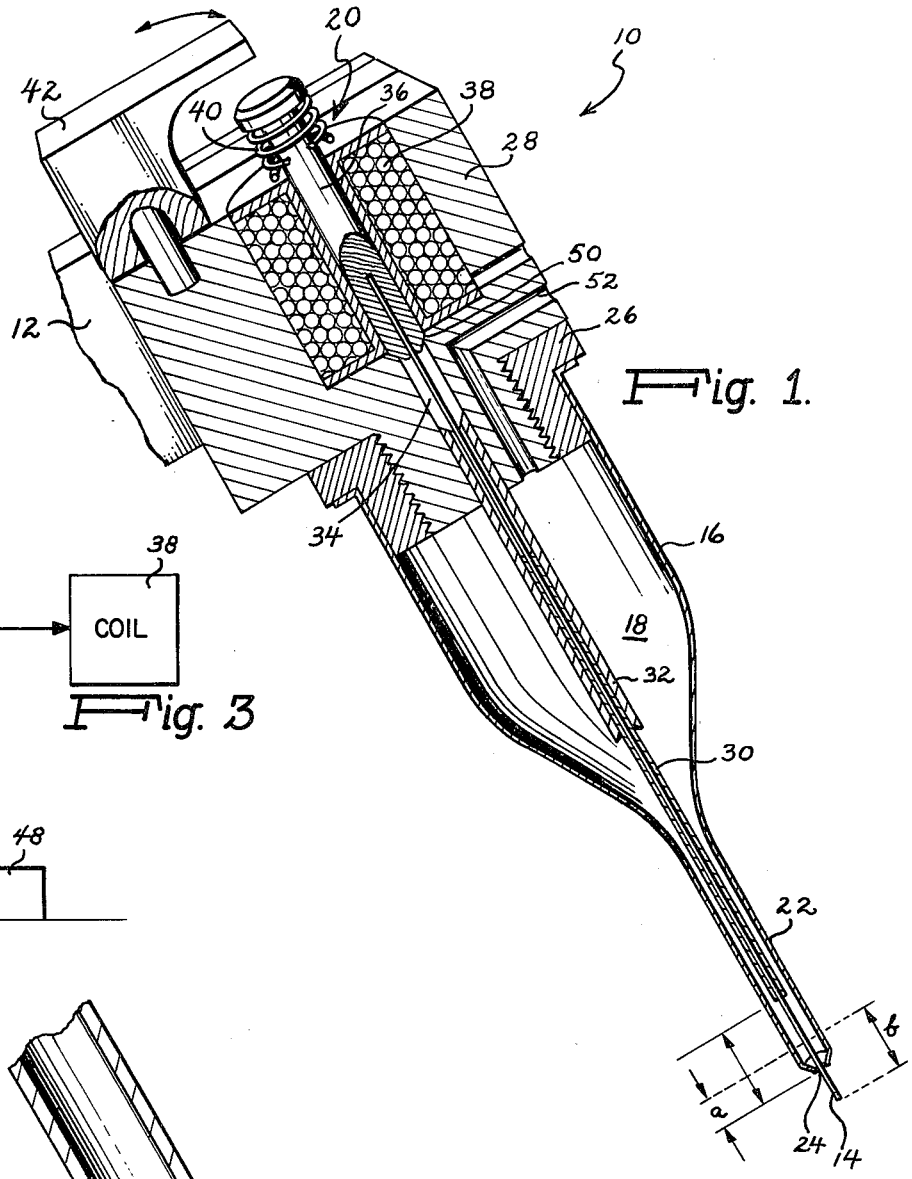
FIG. 1 is a view in perspective and partial section of a marking device or "inker" constructed in accordance with the present invention.

Turning now to the drawings there is shown a marking device constructed in accordance with the present invention and indicated generally by the reference numeral 10. In a typical application, the marker device 10 is used in conjunction with a semiconductor wafer prober (not shown) to identify or otherwise mark selected dies on a semiconductor wafer. In this application, the marker device 10 is mounted (by means not shown) on a support element 12 associated with the semiconductor prober.

The marker device or "inker" 10 comprises an ink dispensing filament 14 such as, a fishline, an ink reservoir 16 which defines an ink containing chamber 18 and a solenoid assembly indicated generally by the reference numeral 20. Looking specifically at FIGS. 1 and 2, it can be seen that the ink reservoir 16 has a generally tulip shape in cross-section and that it terminates in a tubular portion 22 having an ink discharge orifice 24. The ink reservoir 16 is secured to a threaded fastener 26 which is threaded into a solenoid assembly support 28. It will be appreciated that by rotating the threaded fastener 26 and thus the reservoir 16, the axial position of reservoir 16 and its outlet orifice 24 can be adjusted with respect to the filament 14 as indicated by the distance marked "*a*" in FIG. 1. The adjustment is used to control the size of the ink dot produced by the marking device 10. Typically, the size can be varied from 0.018 inch diameter to 0.003 inch diameter without requiring a change in the filament 14. Maximum dot size is achieved with the filament retracted into tubular portion 22.

Positioned within and extending along almost the entire axial length of reservoir 16 is a capillary tube 30 having a representative I.D. of 0.012 inch. The capillary tube 30 is mounted within an anti-wicking tube 32 that is positioned within bore 34 and secured to solenoid assembly 28. The ink dispensing filament 14 is located within and guided by the capillarly tube 30. The upper portion of the filament 14, as viewed in FIG. 1, is secured to a removable, solenoid plunger 36.

When solenoid coil 38 is energized, the plunger is drawn into the coil in a downwardly direction, as viewed in FIG. 1, and the attached filament is driven into contact with a workpiece (not shown). The amount of the filament stroke is indicated by the distance marked "*b*" in FIG. 1. At the same time, the plunger movement compresses return spring 40. When the energizing current to solenoid coil 38 is removed, the plunger and filament move in an upwardly direction, as viewed in FIG. 1, as the return spring 40 returns to the uncompressed state.

The entire plunger and filament can be removed easily from the marking device 10 by merely rotating a pivotally mounted plunger lock 42 as indicated by the arrows in FIG. 1. Once the plunger lock 42 is rotated, the plunger 36 and attached filament 14 can be withdrawn from the marking device 10.

Figure 3:
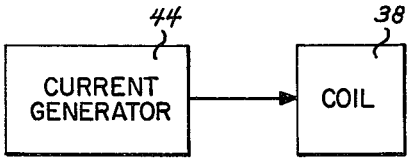
FIG. 3 is block diagram of the current generator and inker solenoid coil.

Electrical current for energizing solenoid coil 38 is obtained from a current generator 44 shown in block diagram form in FIG. 3. In the preferred embodiment, the current generator 44 produces a current waveform depicted in idealized form in FIG. 4. The FIG. 4 current waveform is plotted with current magnitude increasing on the vertical axis and time increasing on the horizontal axis. The waveform has two different current levels: an initial or first current level 46 and a lower, second current level 48.

Figure 4:
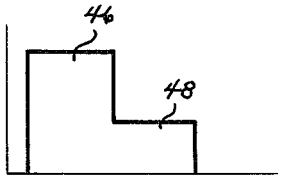
FIG. 4 is a waveform diagram showing an idealized current waveform for energizing the marking device solenoid coil.

Assuming that the solenoid coil 38 is energized by the current waveform shown in FIG. 4, during the first current level 46 the solenoid plunger 36 is drawn into coil 38 until it encounters a mechanical stop 50. The inward movement of solenoid plunger 36 forces the filament or fishline 14 to protrude out of the reservoir outlet orifice 24. This action ruptures the ink meniscus at the outlet orifice 24 and propels an ink drop to the semiconductor die or work piece (not shown). The filament 14 does not contact the die itself. At this point in the operation of a conventional inker, the solenoid coil would simply be de-energized and the fishline would retract back into the reservoir guide tube 30. However, in the embodiment of the present invention depicted in the drawings, the plunger is light enough in mass that a short holding current in the coil is used to prevent a droplet from forming at the otherwise high rectraction speed. The holding current is provided by the second current level 48. Full retraction of the filament occurs at the end of the second current level. Thus, by controlling the retracting force separately from the impelling force, one can prevent the propelled ink drop from splattering.

It has been previously mentioned that the ink reservoir 16 is maintained at ambient pressure. This is acheived through a small relief tube 52 located in the top of reservoir 16. The relief tube provides pressure equalization while at the same time maintaining evaportation of the ink within chamber 18 at a minimum.

Figure 2:
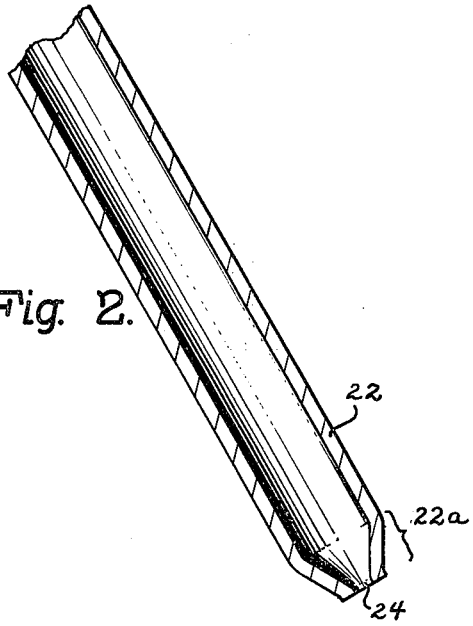
FIG. 2 is an enlarged view in cross-section of the ink dispensing portion of the marking device of FIG. 1.

Looking at FIGS. 1 and 2, it can be seen that the bottom of the reservoir 16 narrows down into tubular portion 22. If the "inker" is used in conjunction with a semi-conductor wafer prober, the "tulip" shape of the reservoir permits visability of the surrounding probes.

It should be noted, however, that the tubular portion 22 is still comparatively large, in the preferred embodiment the tubular portion 22 has an inside diameter of 0.050 inch. The end of tubular portion 22 tapers very sharply into the reservoir outlet orifice 24. The tapered portion **22*a* should be as short as possible; in the preferred embodiment the tapered portion 22*a* is approximately 0.010 to 0.020. This configuration is the practical implementation of the ideal case in which the orifice 24 would be a small aperature in a sphere. As shown in the drawings, the outlet orifice 24 is circular or as near circular as possible in order to minimize the area of ink in contact with the air. Given the relatively large inside chamber of portion 22 and small tapered portion 22*a***, a relatively large amount of fluid can be located close to the ink meniscus with the concomitant advantage that the amount of dried ink is kept to a minimum.

Having described in detail a preferred embodiment of our invention, it will now be apparent to those skilled in the art that numerous modifications can be made therein without departing from the scope of the invention as defined in the following claims.

What we claim and desire to secure by Letters Patent of the United States is:

1. A method for operating a marking device having a marking fluid dispensing filament that is driven by a solenoid through a marking fluid reservoir orifice to propel a small amount of marking fluid to a workpiece, said method comprising the steps of:

1. applying an energizing electrical current at a first current level to the coil of the solenoid for a predetermined time, whereby the dispensing filament breaks the marking fluid meniscus and propels the marking fluid to the workpiece; thereafter,
2. reducing the current level of the energizing electrical current to a second and lower level for another predetermined time; and, finally,
3. terminating the application of the energizing electrical current to the solenoid coil.

2. The method of claim 1 wherein the magnitude of the second current level is sufficient to hold the solenoid plunger within the solenoid coil.

3. A method for applying a marking fluid to a workpiece comprising the steps of:

1. positioning a spaced relation to said workpiece, a marking device comprising:
   A. a base;
   B. solenoid means having a coil and a plunger, said solenoid coil being secured with respect to said base;
   C. a reservoir containing a marking fluid, said reservoir having a tubular portion which terminates in an outlet orifice;
   D. filament guide tube means axially positioned within the tubular portion of said reservoir and terminating short of said outlet orifice, said filament guide tube means being fixedly mounted with respect to said base and solenoid coil;
   E. a marking fluid dispensing filament having at least a portion thereof positioned within said filament guide tube means with one end of the filament extending outwardly therefrom toward the reservoir outlet orifice and the other end being secured to said solenoid plunger; and,
   F. means for mounting said reservoir with respect to said base and solenoid coil;
2. energizing the solenoid coil at a first current level for a predetermined period of time to drive the marking fluid dispensing filament through the meniscus of the marking fluid at the reservoir outlet orifice to propel a small amount of said fluid to the workpiece;
3. reducing the current level of the energizing electrical current to a second and lower level for another predetermined time; and, finally,
4. terminating the application of the energizing electrical current to the solenoid coil.

4. The method of claim 3 wherein the magnitude of the second current level is sufficient to hold the plunger within the solenoid coil.

* * * * *